US007473007B1

(12) United States Patent
Wang

(10) Patent No.: US 7,473,007 B1
(45) Date of Patent: Jan. 6, 2009

(54) ADJUSTABLE LAMP

(76) Inventor: Cheng-Kuo Wang, No. 1, Lane 36, Daren St., Sanchong City, Taipei County (TW)

( * ) Notice: Subject to any disclaimer, the term of this patent is extended or adjusted under 35 U.S.C. 154(b) by 52 days.

(21) Appl. No.: 11/894,830

(22) Filed: Aug. 22, 2007

(51) Int. Cl.
*F21L 4/00* (2006.01)

(52) U.S. Cl. ..... 362/187; 362/277; 362/300; 362/304; 362/319; 362/346

(58) Field of Classification Search ..... 362/186, 362/187, 277, 280, 293, 300, 302, 304, 346, 362/514, 517
See application file for complete search history.

(56) References Cited

U.S. PATENT DOCUMENTS 6,598,993 B1 * 7/2003 Dalton et al. ..... 362/319
7,021,806 B2 * 4/2006 Ovenshire ..... 362/302
7,360,920 B2 * 4/2008 Dalton et al. ..... 362/187

FOREIGN PATENT DOCUMENTS

| | | |
|---|---|---|
| TW | 290502 | 1/2006 |
| TW | 297430 | 11/2006 |
| TW | 299254 | 11/2006 |

* cited by examiner

*Primary Examiner*—Stephen F Husar
(74) *Attorney, Agent, or Firm*—Frenkel & Associates, P.C.

(57) ABSTRACT

An adjustable lamp includes a lamp and a scattering shade which is slidable on the lamp. The scattering shade has a front end coupled with a reflective blade which is bent at a selected angle to reflect light. By sliding the scattering shade on a light penetrative shade, the position of the reflective blade can be changed to alter the reflective direction of the light.

18 Claims, 7 Drawing Sheets

ADJUSTABLE LAMP

FIELD OF THE INVENTION

The present invention relates to an adjustable lamp and particularly to an adjustable structure for a handheld lamp to adjust light projecting direction.

BACKGROUND OF THE INVENTION

There are a wide variety of handheld lamps on the market. For instance R.O.C. patent Nos. M299254 entitled "Flashlight", M297430 entitled "Flashlight" and M290205 entitled "Multifunctional structure for flashlights to provide versatile light" generally have a barrel case to house a power supply and a switch circuit, and at least one lamp bulb at a front end to form a portable flashlight to facilitate carrying. The flashlights thus formed have the light converging at the front side. They mostly focus on improvements of the style, function and light intensity, but do not provide a structure to alter light projection. Hence they mostly have the light focusing in one direction. Camping lamp is another type of portable lighting feature to provide light projection for a greater area during camping outdoors. Its light projects outwards transversely to illuminate the surrounding environment of the lamp. It projects light in directions different from the conventional flashlights. To go outdoors for travel or doing recreational activities has to carry two sets of lamps. They occupy a lot of space and incur great inconvenience. The present invention aims to provide an improved handheld lamp that can alter light projecting direction to meet requirements of different environments.

SUMMARY OF THE INVENTION

The primary object of the present invention is to provide a lamp that can alter light projecting direction to achieve multiple functions and meet requirements in outdoor or various environments.

The invention provides an adjustable lamp which has an improved structure to change light reflective direction. The adjustable lamp of the invention includes a case, a socket embedded on the case and a reflective structure. The case has a switch circuit and holds batteries. The socket has at least one lamp bulb and is electrically connected to the switch circuit to get electric power to light the lamp bulb. The lamp bulb includes a filter blade which is replaceable to change the color of light. The reflective structure includes a light penetrative shade, a scattering shade and a reflective blade embedded on an inner side of the scattering shade. The light penetrative shade is located at a front end of the case, and has a front end indented inwards to form a trough to surround and protect the lamp bulb and the filter blade. The scattering shade is coupled on the periphery of the light penetrative shade and slidable thereon. The reflective blade is located in the center of the inner side of a front end of the scattering shade, and bent inwards to reflect light at a desired angle. With the scattering shade sliding on the light penetrative shade the position of the reflective blade can be changed, therefore light projecting direction can be changed to achieve multiple functions.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
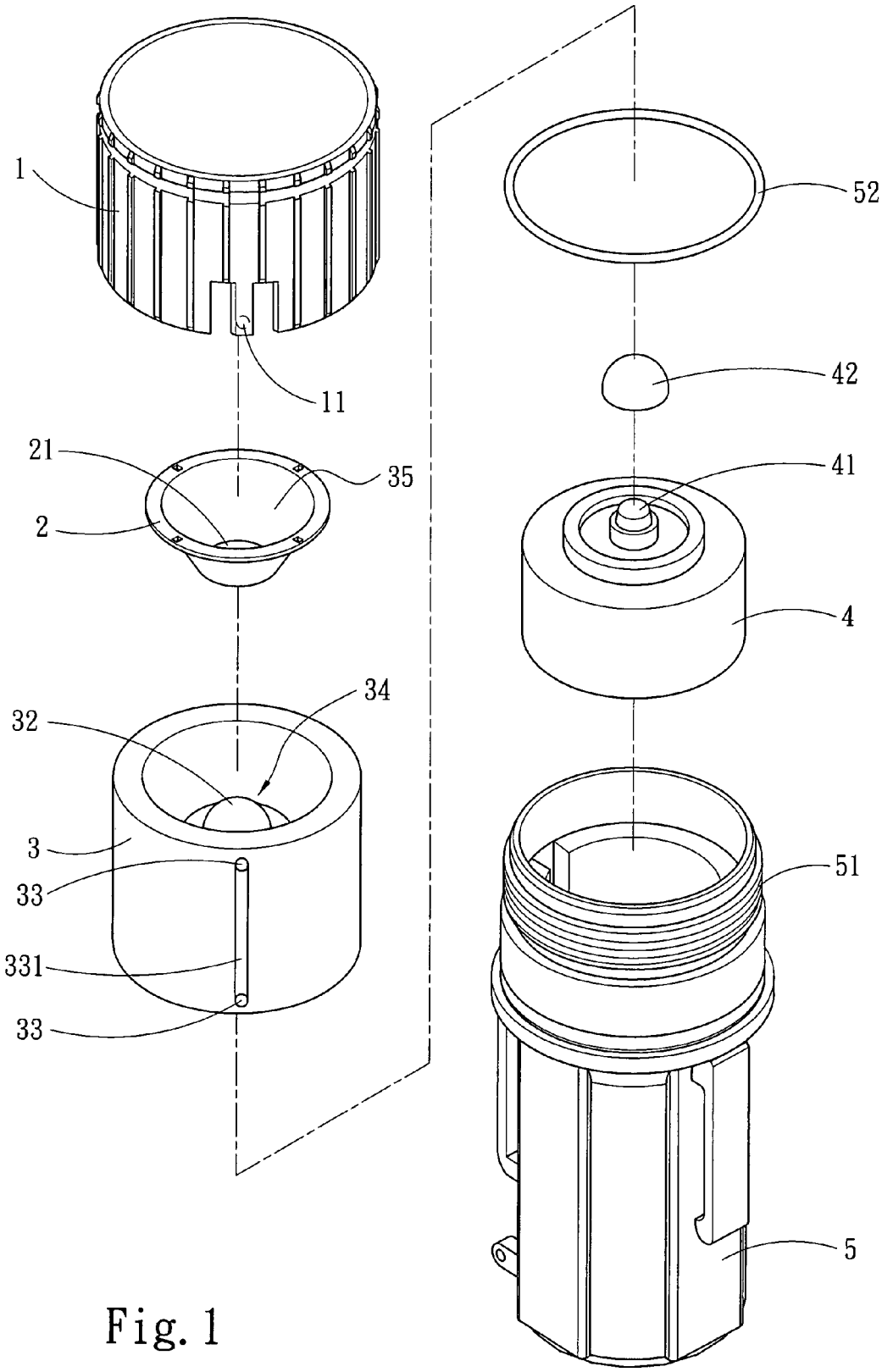
FIG. 1 is an exploded view of a first embodiment of the invention.
Figure 2:
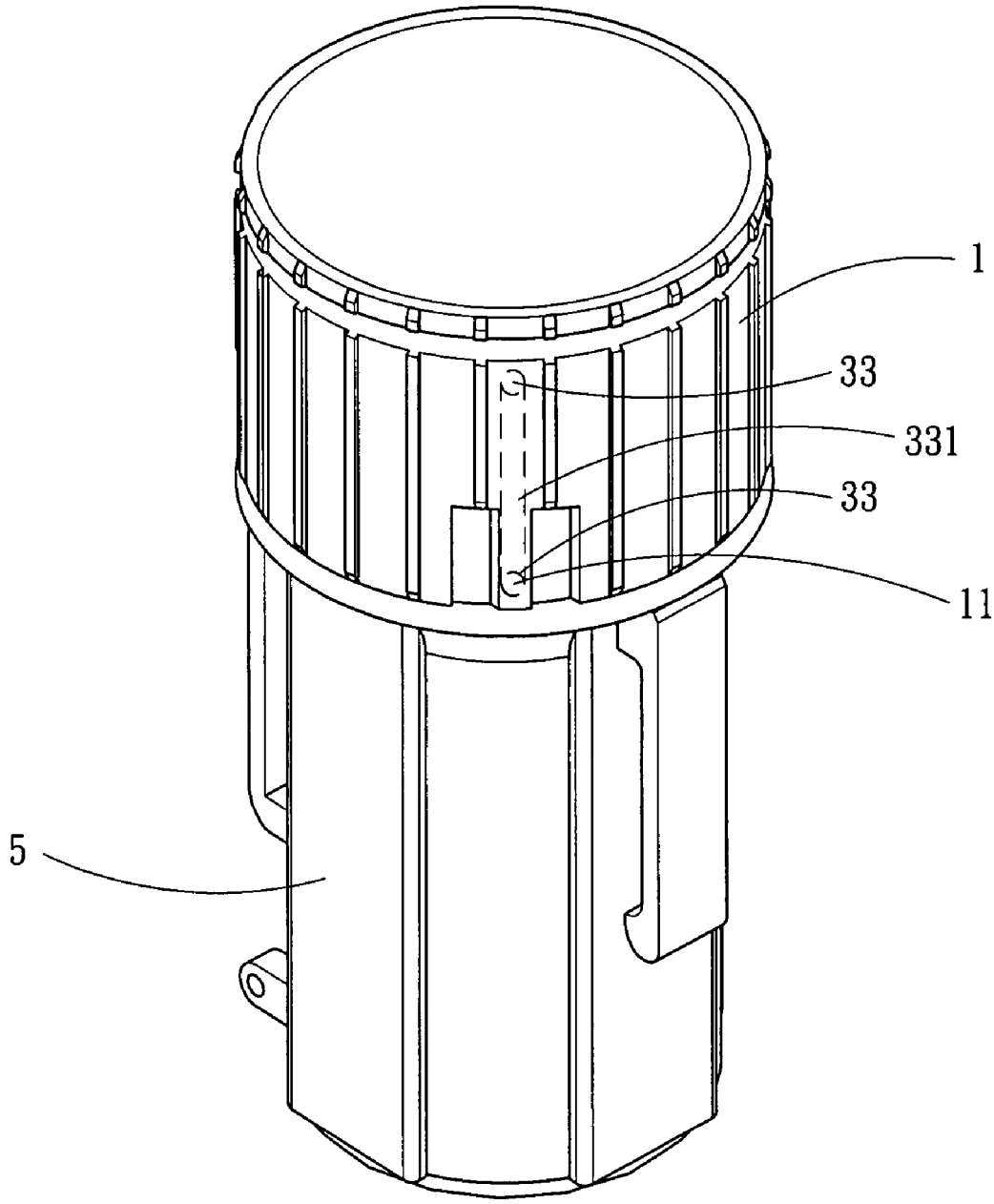
FIG. 2 is a perspective view of the first embodiment of the invention.

Please refer to FIGS. 1 and 2, the adjustable lamp of the invention includes a case 5, a socket 4 embedded on the case 5 and a reflective structure coupling with the lamp. The reflective structure includes a light penetrative shade 3, a scattering shade 1 and a reflective blade 2. The socket 4 has a lamp bulb 41 located thereon. There is a filter blade 42 located above the lamp bulb 41 that is replaceable to change the color of light projected from the invention. The light penetrative shade 3 has a rear end coupling on the periphery of the case 5. The case 5 has an external screw thread 51. The light penetrative shade 3 has an internal screw thread 31 engageable with the external screw thread 51. The case 5 and the light penetrative shade 3 are interposed by a washer 52 to provide watertight function. The light penetrative shade 3 has a front end indented inwards to form a trough 34 which has an inner side to hold a reflective layer 35. The lamp bulb 41 further is covered by a light penetrative lamp shade 32 on the upper side. The lamp shade 32 encases the lamp bulb 41 to protect the lamp bulb 41 and the filter blade 42. The scattering shade 1 is coupled on the periphery of the light penetrative shade 3 and has a front end with an inner rim formed in the center to be coupled with the reflective blade 2. The reflective blade 2 is bent inwards to be held in the trough 34 at the front end of the light penetrative shade 3. The reflective blade 2 and the trough 34 are formed in the same shape. The reflective blade 2 further has an opening 21 in the center to allow the lamp shade 32 in the center of the light penetrative shade 3 to pass through. By means of the construction set forth above a handheld lamp with an adjustable structure is formed as shown in FIG. 2.

Figure 3A:
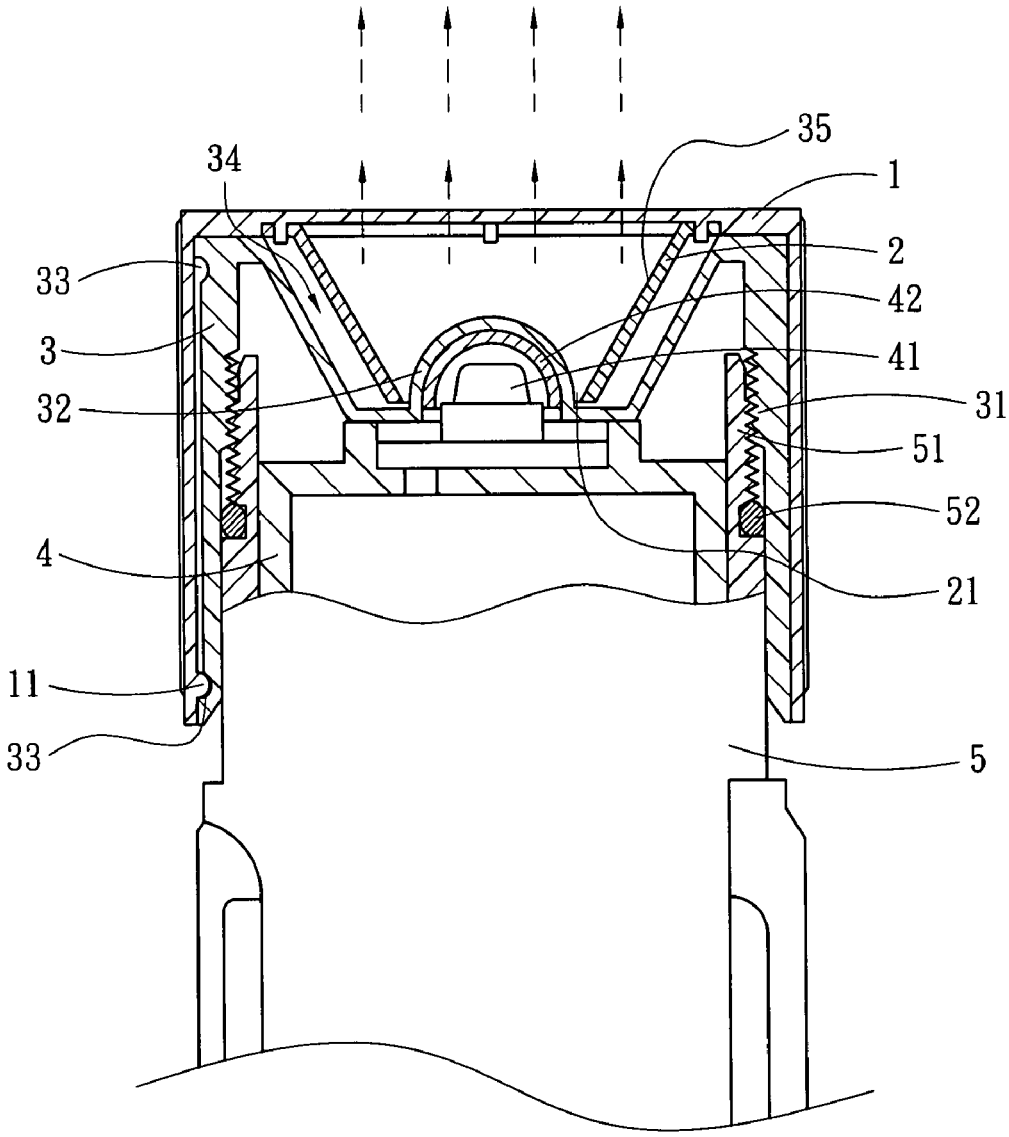
FIG. 3A is a first sectional view of the first embodiment of the invention.
Figure 3B:
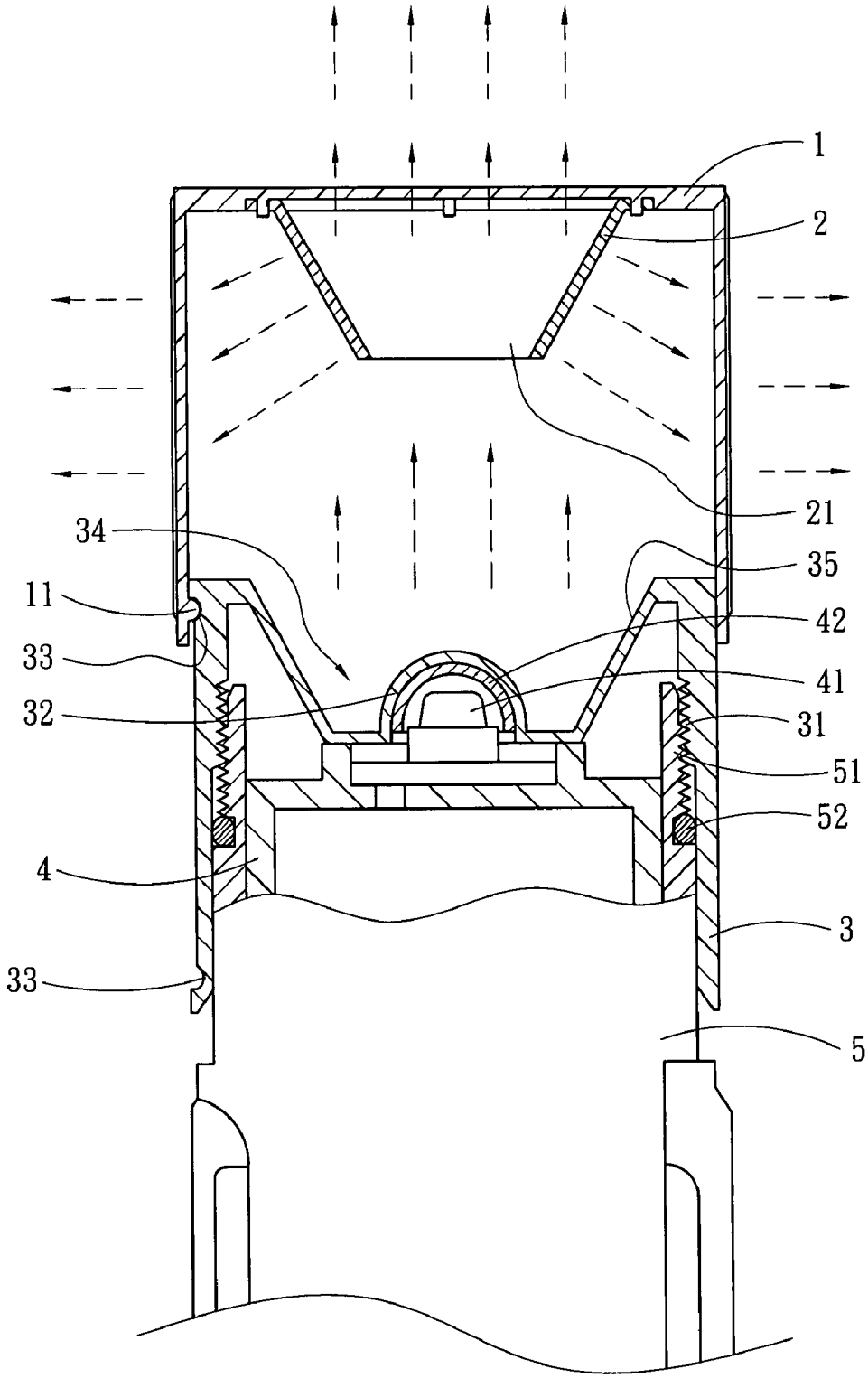
FIG. 3B is a second sectional view of the first embodiment of the invention.

Referring to FIG. 3A, the light penetrative shade 3 and the case 5 are coupled by screwing the internal screw thread 31 with the external screw thread 51. The light penetrative shade 3 has a plurality of retaining grooves 33 formed on the periphery which is coupled with the scattering shade 1. The retaining grooves 33 are formed by carving from a front end to a rear end of the light penetrative shade 3 and spaced from one another at a selected interval. There is a sliding track 331 running across the retaining grooves 33. The scattering shade 1 further has at least one lug 11 formed at an inner rim and a notch at each of two sides of the lug 11. Therefore the lug 11, can be slightly moved under pushing. The lug 11 is formed in a shape to be wedged in the retaining grooves 33 to latch and anchor the light penetrative shade 3 and the scattering shade 1. The lug 11 wedged in the retaining grooves 33 can be slid in the sliding track 331 and moved from one retaining groove 33 to another retaining groove 33. Therefore the scattering shade 1 can be slid or anchored on the periphery of the light penetrative shade 3. When the lug 11 is slid rearwards to the retaining groove 33 at the most inner side as shown in FIG. 3A, the lamp shade 32 passes through the opening 21 in the center of the reflective blade 2, and light generated by the lamp bulb 41 is reflected by the inner side of the reflective blade 2 and converged to the front side to function like an ordinary flashlight. When the lug 11 is slid forwards to the retaining groove 33 at the outmost side as shown in FIG. 3B, the light generated by the lamp bulb 41 is reflected by the reflective layer 35 and the outer side of the reflective blade 2, and refracted and evenly projects transversely outwards through the scattering shade 1. In such a condition it can function as a camping lamp or an emergency mark. Thus multiple functions can be achieved.

Figure 4:
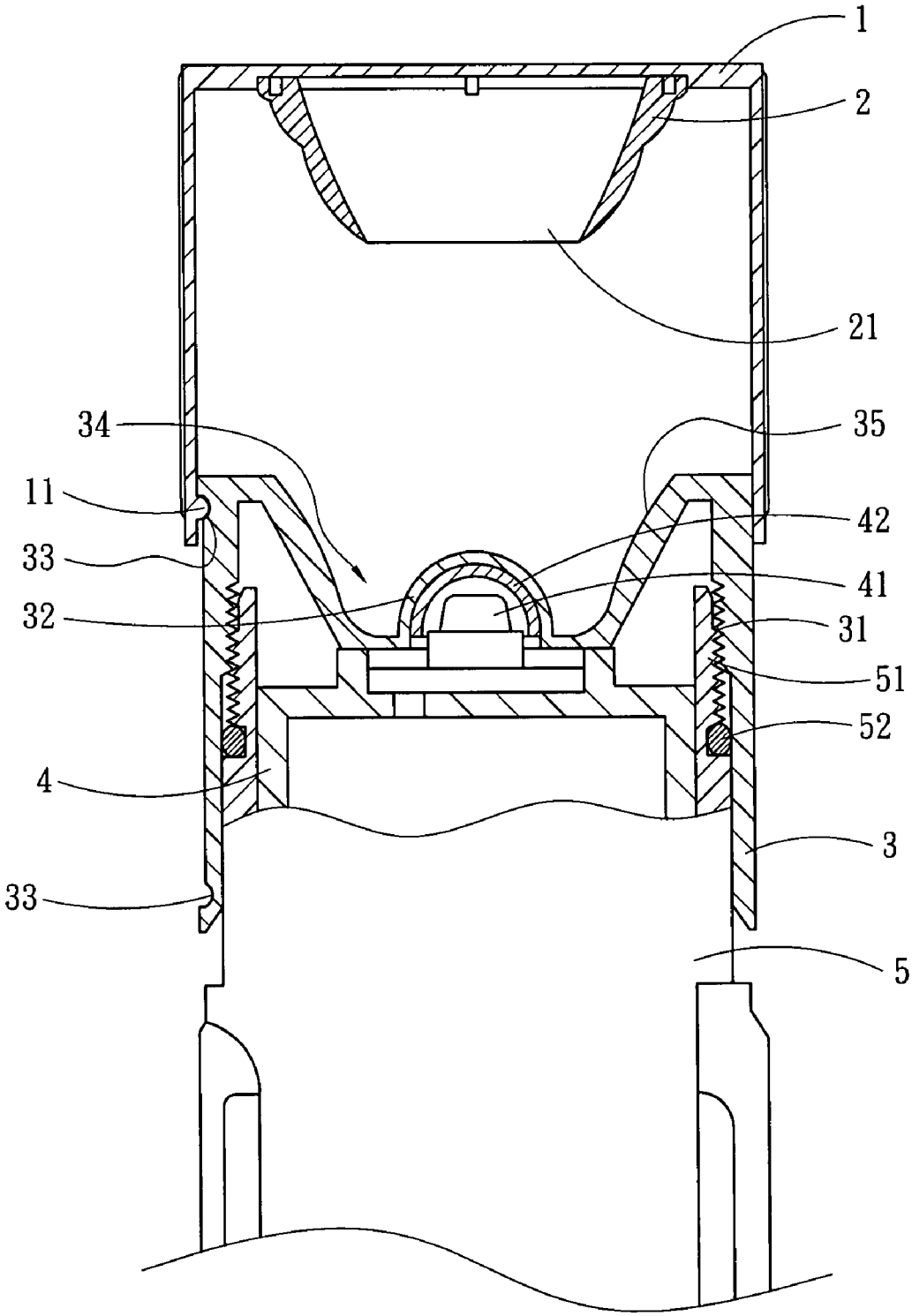
FIG. 4 is a sectional view of a second embodiment of the invention.

Refer to FIG. 4 for another embodiment of the invention. The reflective blade 2 and the reflective layer 35 at the front end of the light penetrative shade 3 can be formed with a curved surface or a plurality of curved surfaces, or a plurality of planar surfaces in different angles to change the refractive direction of light to achieve different illumination effects.

The light penetrative shade 3 previously discussed is positioned on the retaining grooves 33 at the most inner side and outmost side. However, there is no limitation in terms of the number and locations of the retaining grooves 33. Hence the light penetrative shade 3 may have more than two retaining grooves 33 to achieve positioning adjustment at multiple stages. The scattering shade 1 may also be formed with diamond cutting surfaces to refract the light more effectively. The lamp bulb 41 may be substituted by a light emitting diode. The case 5 has a housing space inside to hold the replaced filter blade 42 to meet light projecting requirements of different environments.

Figure 5:
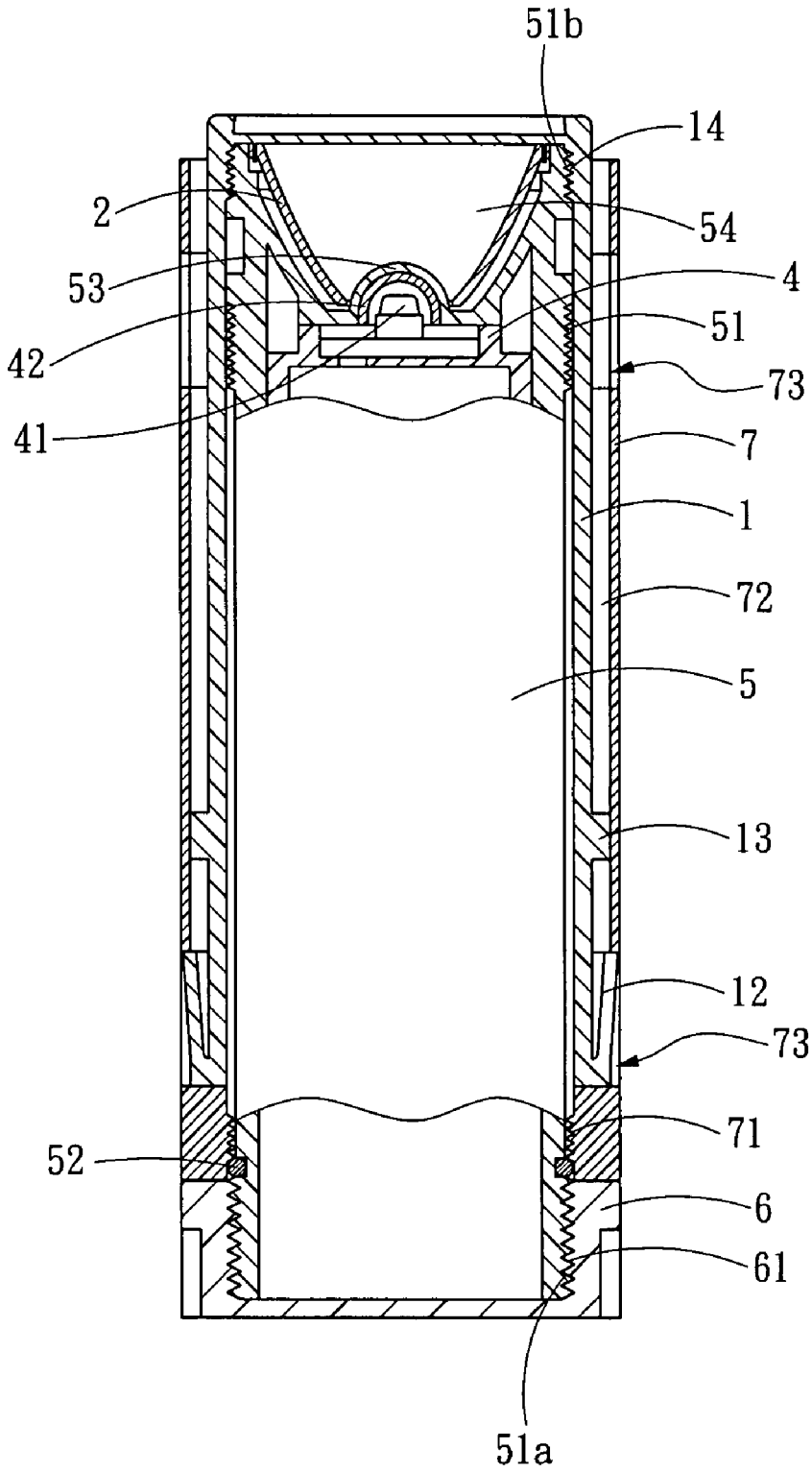
FIG. 5 is a sectional view of a third embodiment of the invention.
Figure 6:
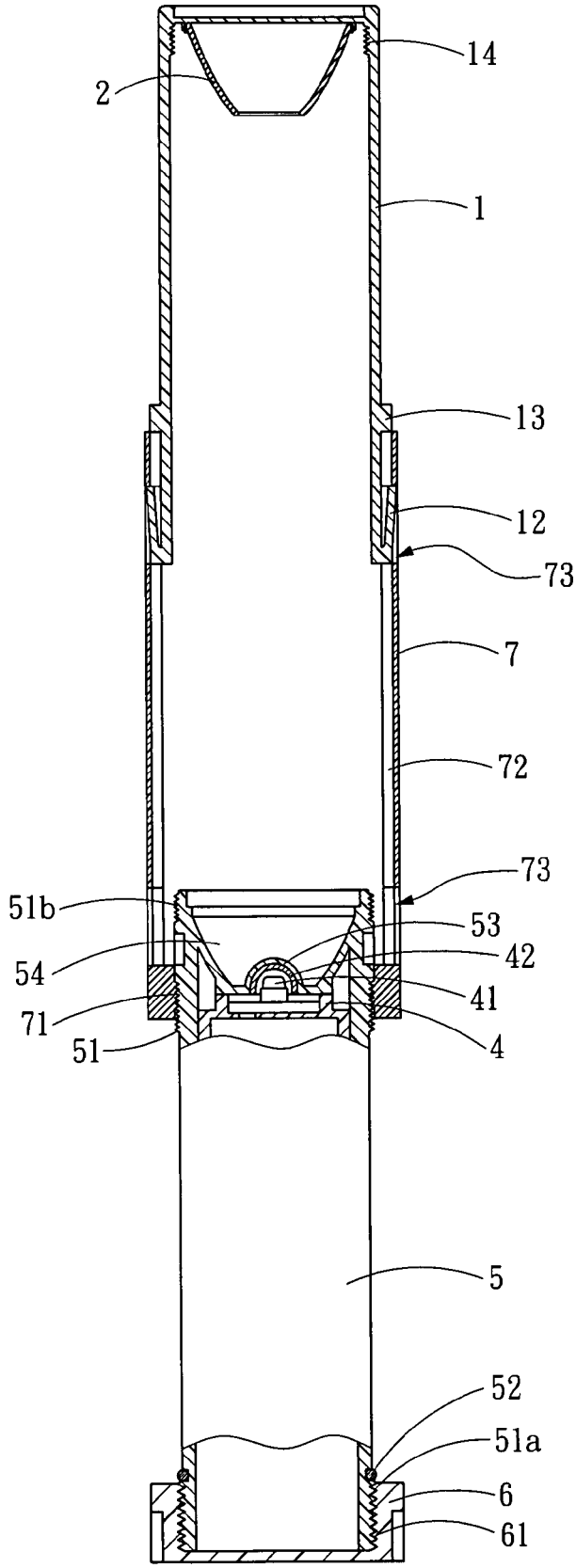
FIG. 6 is another sectional view of the third embodiment of the invention.

Refer to FIGS. 5 and 6 for a third embodiment of the invention. The case 5 and the light penetrative shade 3 may be formed in an integrated manner with the case 5 replacing the light penetrative shade 3 of the previous embodiments. The front end of the case 5 still is coupled with the socket 4. The case 5 has a front end indented inwards to form a trough 54 which has a bottom to encase the socket 4 and a penetrative lamp shade 53 on the periphery of the lamp bulb 41. The case 5 further has external screw threads 51, 51*a* and 51*b* formed respectively at the front end, rear end and a location between the front end and the center to be screwed with an internal screw thread 61 formed on a base 6. The external screw thread 51*b* at the front end of the case 5 is screwed with an internal screw thread 14 of the scattering shade 1. In this embodiment the scattering shade 1 is wedged in an inner rim of an extension duct 7 which has a distal end with an internal screw thread 71 formed thereon to be screwed with the external screw thread 51 at the front end of the case 5 to anchor the relative position of the case 5 and the extension duct 7. The screwed position of the extension duct 7 and the external screw thread 51 and the base 6 form a displacement between them. The extension duct 7 has at least one sliding track 72 at an inner side that allows a sliding member 13 located on the outer side of the scattering shade 1 to slide thereon. The scattering shade 1 further has at least one latch blade 12 at a distal end. The extension duct 7 has at least one anchor hole 73 at a front end and a rear end. When the scattering shade 1 is slid forwards or rearwards to be retracted, the latch blade 12 is wedged in the anchor hole 73 to anchor the scattering shade 1 and the extension duct 7 at a relative position. The extension duct 7 also can be moved forwards to be screwed with the external screw thread 51 so that the scattering shade 1 and the extension duct 7 are extended at the front side of the case 6. In cooperating with the reflective blade 2 coupled on the inner side of the scattering shade 1, light generated by the lamp bulb 41 can be projected outwards through the lateral edge of the scattering shade 1 to form a baton fashion (referring to FIG. 6).

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An adjustable lamp comprising a lamp and a reflective structure, the lamp including at least a case, a socket wedged in the case that holds at least one lamp bulb, the reflective structure including:

a light penetrative shade which is coupled with a front end of the case and has a front end indented inwards to form a trough which has an inner side holding a reflective layer; the lamp bulb being covered by a lamp shade at an upper side and the surrounding thereof; and a scattering shade which is coupled on the light penetrative shade and slidable thereon, and has a front end with an inner rim formed in the center to be coupled with a reflective blade, the reflective blade being bent inwards at a selected angle to reflect light and having an opening in the center to allow the lamp shade to pass through so that the reflective blade is movable to different locations through sliding of the scattering shade on the light penetrative shade to reflect the light.

2. The adjustable lamp of claim 1, wherein the light penetrative shade and the case have respectively an internal screw thread and an external screw thread that are screwable with each other.

3. The adjustable lamp of claim 1, wherein the lamp bulb includes a filter blade to change the color of the light.

4. The adjustable lamp of claim 3, wherein the filter blade is replaceable.

5. The adjustable lamp of claim 1, wherein the light penetrative shade further has a plurality of retaining grooves.

6. The adjustable lamp of claim 5, wherein the retaining grooves are formed by carving from a front end to a rear end of the light penetrative shade and spaced from one another at a selected interval.

7. The adjustable lamp of claim 6, wherein the scattering shade has an inner rim which has at least one lug formed thereon, the lug being wedgeable in the retaining grooves to form a structure to allow the scattering shade to be slid and anchored.

8. The adjustable lamp of claim 1, wherein the case and the light penetrative shade are interposed by a washer to provide watertight function.

9. The adjustable lamp of claim 1, wherein the trough of the light penetrative shade is formed in a shape the same as the reflective blade.

10. The adjustable lamp of claim 1, wherein the scattering shade has diamond cutting surfaces.

11. The adjustable lamp of claim 1, wherein the lamp bulb is a light emitting diode.

12. The adjustable lamp of claim 1, wherein the case has a housing space to hold a replaced filter blade.

13. The adjustable lamp of claim 1, wherein the reflective blade has at least one curved surface.

14. The adjustable lamp of claim 1, wherein the reflective blade includes a plurality of planar surfaces formed at different angles.

15. The adjustable lamp of claim 1, wherein the reflective layer has at least one curved surface.

16. The adjustable lamp of claim 1, wherein the reflective layer includes a plurality of planar surfaces formed at different angles.

17. The adjustable lamp of claim 1, wherein the case and the light penetrative shade are formed integrally.

18. The adjustable lamp of claim 17, wherein the case has a plurality of external screw threads on the periphery to be screwed respectively with an extension duct, the scattering shade and a base, the extension duct and the external screw thread being engaged at a position spaced from the base to form a displacement, the extension duct having at least one sliding track to allow the scattering shade to slide on an inner side of the extension duct.

* * * * *